US008736641B2

(12) United States Patent
Byun et al.

(10) Patent No.: US 8,736,641 B2
(45) Date of Patent: May 27, 2014

(54) APPARATUS AND METHOD FOR DRIVING ORGANIC LIGHT EMITTING DISPLAY DEVICE

(75) Inventors: Seung Chan Byun, Paju-si (KR); Hyoung-Su Kim, Deogeun-ri (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/313,801

(22) Filed: Dec. 7, 2011

(65) Prior Publication Data

US 2012/0147065 A1 Jun. 14, 2012

(30) Foreign Application Priority Data

Dec. 13, 2010 (KR) ..... 10-2010-0126959

(51) Int. Cl.
*G09G 5/10* (2006.01)
*G09G 3/30* (2006.01)

(52) U.S. Cl.
USPC ..... 345/690; 345/77

(58) Field of Classification Search
USPC ..... 345/102, 204, 207, 213, 419, 589, 60, 345/63, 690, 691, 694, 77, 88, 96; 348/674, 348/739, 252; 382/252; 257/773, 798; 313/498, 500, 503
See application file for complete search history.

(56) References Cited

U.S. PATENT DOCUMENTS

| | | | | |
|---|---|---|---|---|
| 7,705,810 | B2 * | 4/2010 | Choi et al. | 345/77 |
| 8,330,152 | B2 * | 12/2012 | So | 257/40 |
| 2004/0222999 | A1 | 11/2004 | Choi et al. | |
| 2008/0018798 | A1 | 1/2008 | Park et al. | |
| 2008/0043045 | A1 | 2/2008 | Natori et al. | |
| 2009/0160871 | A1 * | 6/2009 | Hsu et al. | 345/589 |
| 2012/0105517 | A1 * | 5/2012 | Yang et al. | 345/694 |

FOREIGN PATENT DOCUMENTS

| | | | |
|---|---|---|---|
| CN | 101114423 | A | 1/2008 |
| KR | 10-2004-0067851 | A | 7/2004 |
| KR | 20040096273 | A | 11/2004 |
| KR | 10-2010-0119653 | A | 11/2010 |
| KR | 20110070176 | A | 6/2011 |
| WO | WO 2010/103433 | A1 | 9/2010 |

OTHER PUBLICATIONS

Office Action issued in corresponding Chinese Patent Application No. 201110412370.2, mailed Jan. 13, 2014, 18 pages.

* cited by examiner

*Primary Examiner* — Sumati Lefkowitz
*Assistant Examiner* — Douglas M Wilson
(74) *Attorney, Agent, or Firm* — Brinks Gilson & Lione

(57) ABSTRACT

Disclosed are an apparatus and method for driving an organic light emitting display device. The driving apparatus includes a display panel, a data converter, a timing controller, and a panel driver. The data converter gamma-corrects three-color input data having red, green, and blue, performs color coordinate conversion based on the gamma-corrected blue data to generate three-color conversion data and a color gamut determination signal, inversely gamma-corrects the three-color conversion data, and generates four-color image data to be supplied to a unit pixel according to the color gamut determination signal on the basis of the three-color input data and the inversely gamma-corrected three-color conversion data.

16 Claims, 8 Drawing Sheets

APPARATUS AND METHOD FOR DRIVING ORGANIC LIGHT EMITTING DISPLAY DEVICE

Pursuant to 35 U.S.C. §119(a), this application claims the benefit of earlier filing date and right of priority to Korean Application 10-2010-0126959 filed on Dec. 13, 2010, the content of which is incorporated by reference herein in its entirety.

BACKGROUND

1. Field of the Invention

The present disclosure relates to an organic light emitting display device, and more particularly, to an apparatus and method for driving an organic light emitting display device, which extend the service life of the organic light emitting display device and enhance color reproducibility.

2. Discussion of the Related Art

With the advance of multimedia, the importance of Flat Panel Display (FPD) devices has recently increased. Therefore, various FPD devices such as Liquid Crystal Display (LCD) devices, Plasma Display Panel (PDP) devices, Field Emission Display (FED) devices, and organic light emitting display devices are being practically used. In such FPD devices, a driving apparatus of an organic light emitting display device has a fast response time less than a response time of 1 ms, consumes low power, and has a broad viewing angle by self-emitting light. Accordingly, organic light emitting display devices are attracting much attention as next generation FPD devices.

Organic light emitting display devices include a plurality of unit pixels. Each of the unit pixels includes a red (R) sub-pixel having a red organic light emitting material, a green (G) sub-pixel having a green organic light emitting material, and a blue (B) sub-pixel having a blue organic light emitting material. Each unit pixel realizes a certain color by combining red light, green light, and blue light that are emitted from respective sub-pixels thereof.

Since organic light emitting display devices include an organic light emitting material, the service life of the organic light emitting display devices is determined according to that of the organic light emitting material.

Specifically, the service life of the organic light emitting display devices is determined by the blue organic light emitting material having the shortest service life among the red, green, and blue organic light emitting materials.

A blue organic light emitting material can include various materials, but organic light emitting display devices mainly use a sky-blue organic light emitting material or a deep-blue organic light emitting material at the present.

Organic light emitting display devices using a sky-blue organic light emitting material have low power consumption and long service life due to high efficiency, but have a limitation in image quality because a color reproduction rate is low.

Furthermore, organic light emitting display devices using a deep-blue organic light emitting material can realize high image quality because a color reproduction rate is excellent, but have high power consumption and short service life due to low efficiency.

Due to this reason, organic light emitting display devices of the related art cannot satisfy service life and color reproducibility due to a blue organic light emitting material.

BRIEF SUMMARY

A driving apparatus of an organic light emitting display device includes: a display panel including a plurality of unit pixels which include a red sub-pixel, green sub-pixel, first blue sub-pixel, and second blue sub-pixel which are arranged in a certain type of pixel arrangement structure in respective areas which are defined by a plurality of scan lines and data lines; a data converter gamma-correcting three-color input data having red, green, and blue, performing color coordinate conversion based on the gamma-corrected blue data to generate three-color conversion data and a color gamut determination signal, inversely gamma-correcting the three-color conversion data, and generating four-color image data to be supplied to a unit pixel according to the color gamut determination signal on the basis of the three-color input data and the inversely gamma-corrected three-color conversion data; a timing controller aligning the four-color image data in correspondence with the pixel arrangement structure; and a panel driver supplying a data signal, corresponding to each of the four-color image data which are aligned and supplied by the timing controller, to a corresponding sub-pixel.

In another aspect, there is provided a driving method of an organic light emitting display device including: gamma-correcting three-color input data having red, green, and blue; performing color coordinate conversion based on the gamma-corrected blue data to generate three-color conversion data and a color gamut determination signal; inversely gamma-correcting the three-color conversion data; generating four-color image data to be supplied to a unit pixel according to the color gamut determination signal on the basis of the three-color input data and the inversely gamma-corrected three-color conversion data, wherein the unit pixel includes a red sub-pixel, a green sub-pixel, a first blue sub-pixel, and a second blue sub-pixel; aligning the four-color image data in correspondence with a pixel arrangement structure of the unit pixel; and supplying a data signal, corresponding to each of the aligned four-color image data, to a corresponding sub-pixel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE DRAWINGS AND THE PRESENTLY PREFERRED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
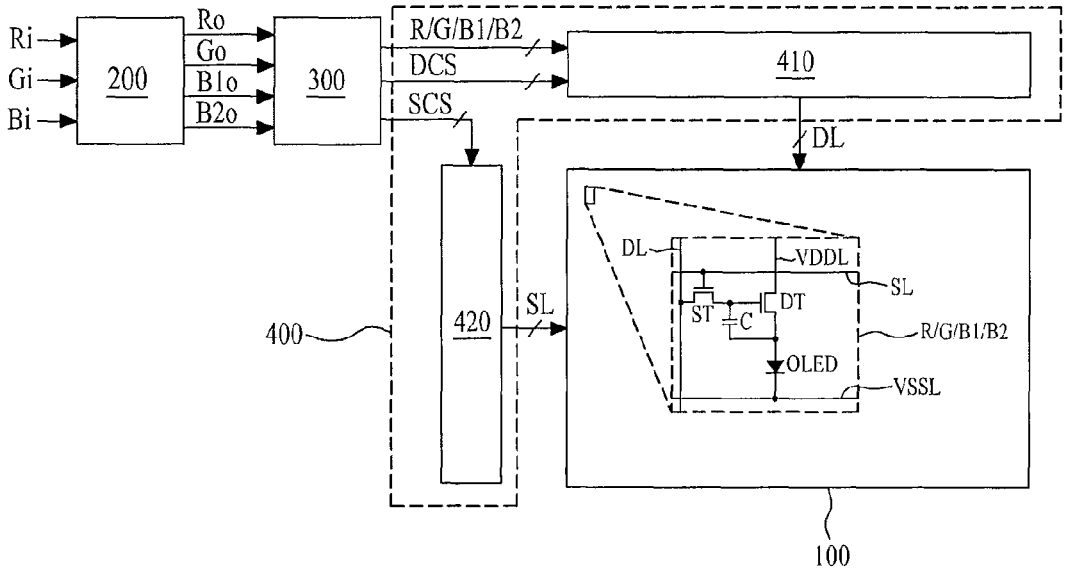
FIG. 1 is a diagram schematically illustrating a driving apparatus of an organic light emitting display device according to an embodiment of the present invention.

FIG. 1 is a diagram schematically illustrating a driving apparatus of an organic light emitting display device according to an embodiment of the present invention.

Referring to FIG. 1, illustrating a driving apparatus of an organic light emitting display device according to an embodiment of the present invention includes a display panel 100, a data converter 200, a timing controller 300, and a panel driver 400.

The display panel 100 includes a plurality of sub-pixels R, G, B and B2 formed in each pixel area that is defined by a plurality of data lines DL, scan lines SL, driving power source lines VDDL, and base power source lines VSSL.

Each of the sub-pixels R, G, B and B2 includes a pixel driving circuit and an organic light emitting element OLED.

The pixel driving circuit supplies a data current, corresponding to a data signal which is supplied to a data line DL, to the organic light emitting element OLED in response to a scan signal supplied to a scan line SL. For this end, the pixel driving circuit according to an embodiment of the present invention includes a switching transistor ST, a driving transistor DT, and a capacitor C.

The switching transistor ST is turned on and supplies a data signal, supplied to the data line DL, to the driving transistor DT according to the scan signal supplied to the scan line SL.

The driving transistor DT is turned on and controls a current which flows from the driving power source line VDDL to the organic light emitting element OLED, according to the data signal supplied from the switching transistor ST.

The capacitor C is connected between a gate of the driving transistor DT and the base power source line VSSL, and stores a voltage corresponding to the data signal supplied to the gate of the driving transistor DT. The capacitor C maintains the constant turn-on state of the driving transistor DT at a low voltage during one frame.

The pixel driving circuit may further include at least one compensation transistor and compensation capacitor (not shown) that compensate for a threshold voltage of the driving transistor DT. Also, the pixel driving circuit may further include an emission transistor (not shown) for selectively supplying a current that is supplied from the driving transistor ST to the organic light emitting element OLED.

The organic light emitting element OLED is electrically connected between a source of the driving transistor DT and the base power source line VSSL, and emits light according to a current corresponding to the data signal that is supplied from the driving transistor DT. For this end, the organic light emitting element OLED includes an anode electrode (or a pixel electrode) connected to a source of the driving transistor DT, an organic layer (not shown) formed on the pixel electrode, and a cathode electrode (or a reflective electrode) formed on the organic layer. Herein, the organic layer may include a Hole Injection layer (HIL), a Hole Transport Layer (HTL), an Emission Layer (EML), an Electron Transport Layer (ETL), and an Electron Injection Layer (EIL).

Each of the sub-pixels R, G, B and B2 controls the level of a current that flows from the driving power source line VDDL to the organic light emitting element OLED according to the turn-on of the driving transistor DT by the data signal, and thus emits light from the emission layer of the organic light emitting element OLED, thereby displaying a certain color.

The sub-pixels are divided into a red sub-pixel R including a red organic light emitting material, a green sub-pixel G including a green organic light emitting material, a first blue sub-pixel B1 including a sky-blue organic light emitting material, and a second blue sub-pixel B2 including a deep-blue organic light emitting Material, based on organic light emitting materials that form the emission layer for realizing a certain color.

Figure 2:
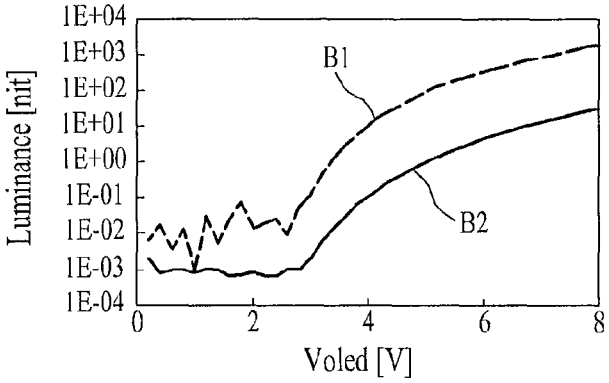
FIG. 2 is a graph showing luminance based on respective voltages of sky-blue and deep-blue organic light emitting display devices in FIG. 1.

As shown in a luminance graph of FIG. 2 based on voltages "Voled" of sky-blue and deep-blue organic light emitting elements OLED, the first and second blue sub-pixels B1 and B2 have different luminance characteristics. That is, when the same voltage "Voled" is applied to the first and second blue sub-pixels B1 and B2, the luminance of the first blue sub-pixel B1 including the sky-blue organic light emitting material is generally higher than that of the second blue sub-pixel B2 including the deep-blue organic light emitting material.

The red sub-pixel R, green sub-pixel G, first blue sub-pixel B1, and second blue sub-pixel B2 that are adjacently formed in the display panel 100 configure one unit pixel.

The red sub-pixel R, green sub-pixel G, first blue sub-pixel B1, and second blue sub-pixel B2 that configure a unit pixel UP may be arranged in various arrangement structures, in the display panel 100.

Figure 3:
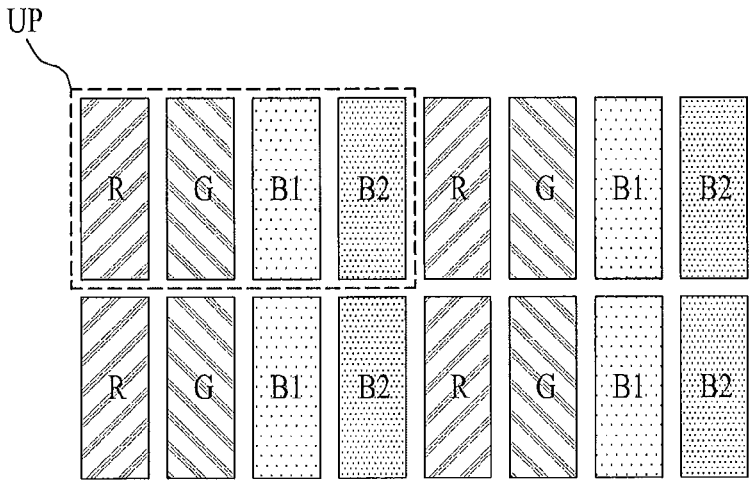
FIG. 3 is a diagram schematically illustrating a pixel arrangement structure which is disposed in a display panel of FIG. 1, according to a first embodiment of the present invention.

In a pixel arrangement structure according to a first embodiment of the present invention, as illustrated in FIG. 3, a red sub-pixel R, green sub-pixel G, first blue sub-pixel B1, and second blue sub-pixel B2 that configure one unit pixel UP are arranged in a stripe type. In this case, the sub-pixels R, G, B1 and B2 of each unit pixel UP are arranged along a scan line SL or a data line DL. For example, the sub-pixels R, G, B1 and B2 of each unit pixel UP are repeatedly arranged along the scan line SL and identically arranged along the data line DL.

Figure 4:
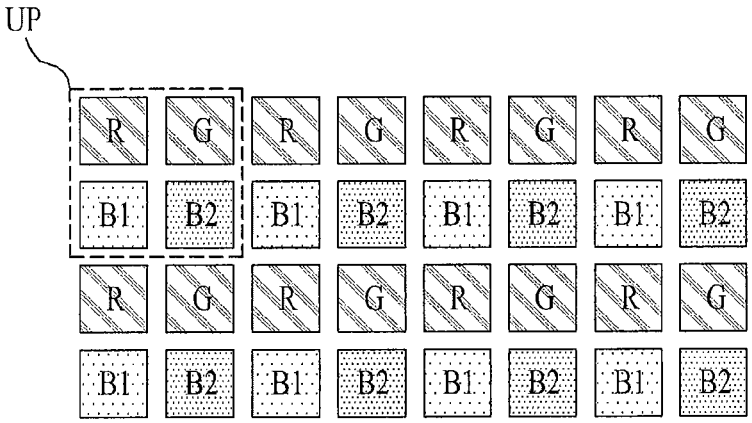
FIG. 4 is a diagram schematically illustrating a pixel arrangement structure which is disposed in the display panel of FIG. 1, according to a second embodiment of the present invention.

In a pixel arrangement structure according to a second embodiment of the present invention, as illustrated in FIG. 4, a red sub-pixel R, green sub-pixel G, first blue sub-pixel B1, and second blue sub-pixel B2 that configure one unit pixel UP are arranged in a quad type. In this case, the sub-pixels R, G, B1 and B2 of each unit pixel UP are arranged along a scan line SL or the data line DL. For example, the sub-pixels R, G, B1 and B2 of each unit pixel UP are repeatedly arranged in a 2×2 matrix type along a scan line SL and data line DL.

Since people's eyes optically have blurring and spatial integration characteristics, people's eyes discern the sub-pixels R, G, B1 and B2 as one or more pixels by combining the sub-pixels R, G, B1 and B2. Therefore, a pixel arrangement structure is set such that two adjacent unit pixels share one sub-pixel or two sub-pixels among the red sub-pixel R, green sub-pixel G, first blue sub-pixel B1, and second blue sub-pixel B2, and visual resolution can be enhanced by the superposition of a shared sub-pixel. In this case, visual resolution can be enhanced through pixel rendering to be described below, without the increase in the number of channels of the data driver 410.

Figure 5:
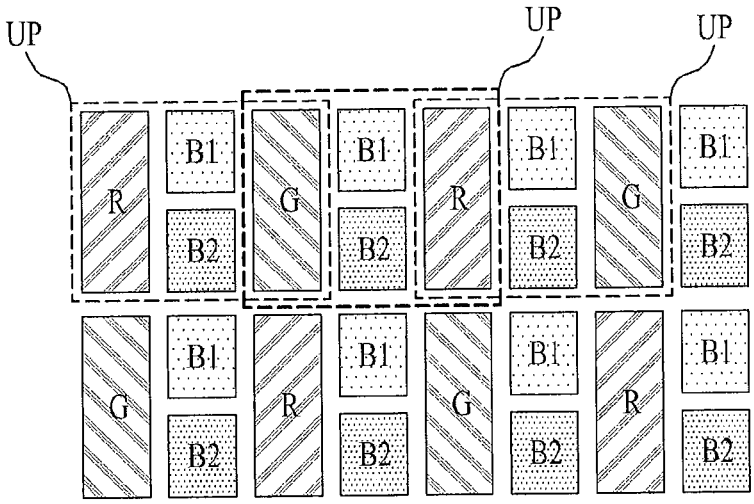
FIG. 5 is a diagram schematically illustrating a pixel arrangement structure which is disposed in the display panel of FIG. 1, according to a third embodiment of the present invention.

In a pixel arrangement structure according to a third embodiment of the present invention, as illustrated in FIG. 5, a red sub-pixel R, green sub-pixel G, first blue sub-pixel B1, and second blue sub-pixel B2 that configure one unit pixel UP have a quad type of pixel arrangement. Two unit pixels UP, which are adjacent to each other along a scan line SL, share a red sub-pixel R or red sub-pixel G. In this case, first and second blue sub-pixels B1 and B2 are formed in two rows between a red sub-pixel R and a green sub-pixel G so as to have an area smaller than that of the red sub-pixel R and green sub-pixel G. Furthermore, the positions of a red sub-pixel R and green sub-pixel G that are arranged in each unit pixel UP are changed in one scan line unit and thus arranged in a zigzag shape along a data line DL.

The pixel arrangement structure according to the third embodiment can reduce the number of data lines DL by ¾ compared to a stripe type of pixel arrangement structure. Accordingly, even when the display panel 100 has a quad type of pixel arrangement structure, a data driver that is applied to an RGB stripe type of pixel arrangement structure can be applied to the pixel arrangement structure according to the third embodiment as-is.

Figure 6:
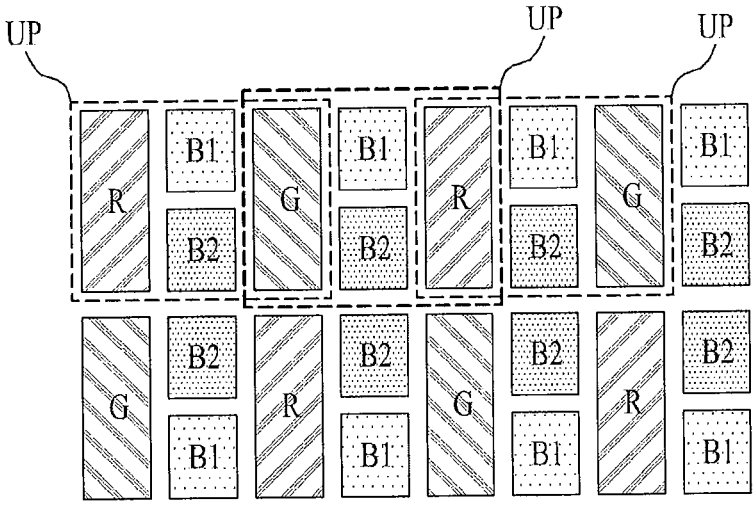
FIG. 6 is a diagram schematically illustrating a modification example of the pixel arrangement structure of FIG. 5 according to the third embodiment of the present invention.

In the pixel arrangement structure according to the third embodiment, as illustrated in FIG. 6, first and second blue sub-pixels B1 and B2 of a unit pixel UP that are vertically adjacent to each other along the data line DL may be arranged oppositely to each other in order to facilitate a process of manufacturing the first and second blue sub-pixels B1 and B2. For example, first and second blue sub-pixels B1 and B2 may be arranged along a data line DL, in an upper unit pixel UP. Second and first blue sub-pixels B2 and B1 may be arranged along a data line DL, in a lower unit pixel UP.

Figure 7:
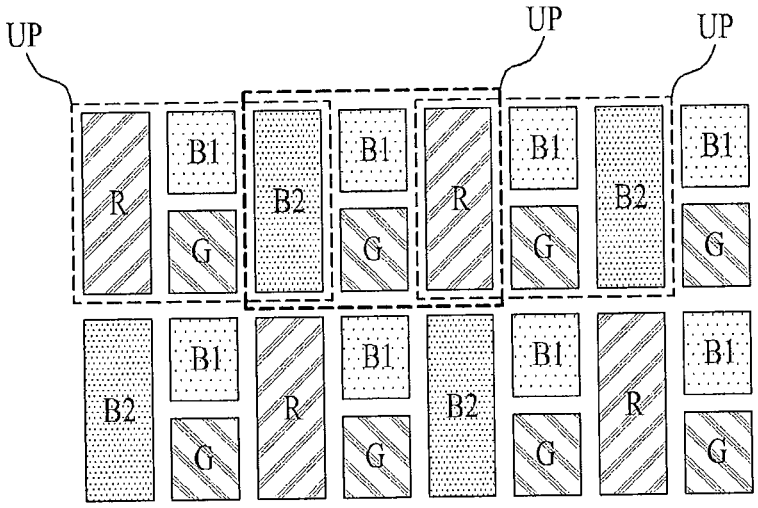
FIG. 7 is a diagram schematically illustrating a pixel arrangement structure which is disposed in the display panel of FIG. 1, according to a fourth embodiment of the present invention.

In a pixel arrangement structure according to a fourth embodiment, as illustrated in FIG. 7, a red sub-pixel R, green sub-pixel G, first blue sub-pixel B1, and second blue sub-pixel B2 that configure one unit pixel UP have a quad type of pixel arrangement. Unit pixels UP, which are adjacent to each other along a scan line SL, share a red sub-pixel R or red sub-pixel G. In this case, a first blue sub-pixel B1 and green sub-pixel G are formed in two rows between a red sub-pixel R and a second blue sub-pixel B2 so as to have an area smaller than that of the red sub-pixel R and second blue sub-pixel B2. Furthermore, the positions of a red sub-pixel R and second blue sub-pixel B2 that are arranged in each unit pixel UP are changed in one scan line unit and thus arranged in a zigzag shape along a data line DL.

Figure 8:
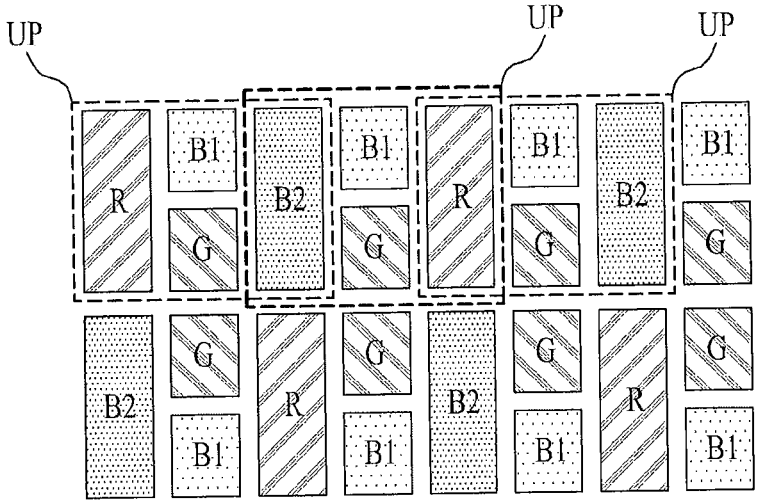
FIG. 8 is a diagram schematically illustrating a modification example of the pixel arrangement structure of FIG. 5 according to the fourth embodiment of the present invention.

In the pixel arrangement structure according to the fourth embodiment, as illustrated in FIG. 8, a first blue sub-pixel B1 and green sub-pixel G of a unit pixel UP that are vertically adjacent to each other along the data line DL may be arranged oppositely to each other in order to facilitate a process of manufacturing the first blue sub-pixel B1 and green sub-pixel G. For example, a first blue sub-pixel B1 and green sub-pixel G may be arranged along a data line DL, in an upper unit pixel UP. A green sub-pixel G and first blue sub-pixel B1 may be arranged along a data line DL, in a lower unit pixel UP.

Figure 9:
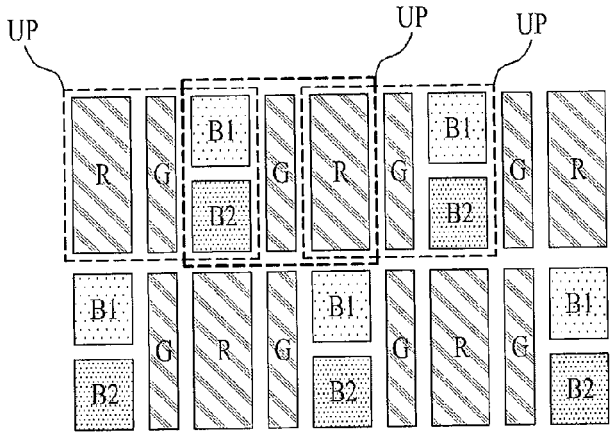
FIG. 9 is a diagram schematically illustrating a pixel arrangement structure which is disposed in the display panel of FIG. 1, according to a fifth embodiment of the present invention.

In a pixel arrangement structure according to a fifth embodiment, as illustrated in FIG. 9, a red sub-pixel R, green sub-pixel G, first blue sub-pixel B1, and second blue sub-pixel B2 that configure one unit pixel UP have a quad type of pixel arrangement. Unit pixels UP, which are adjacent to each other along a scan line SL, share a red sub-pixel R, first blue sub-pixel B1, or second blue sub-pixel B2. In this case, first and second blue sub-pixels B1 and B2 are formed in two rows between green sub-pixels G of adjacent unit pixels UP so as to have an area smaller than that of a red sub-pixel R. Herein, the first and second blue sub-pixels B1 and B2 and green sub-pixel G may have the same area. Furthermore, the respective positions of a red sub-pixel R, and first and second blue sub-pixels B1 and B2 that are arranged in each unit pixel UP are changed in one scan line unit and thus arranged in a zigzag shape along a data line DL.

The above-described pixel arrangement structures according to the third to fifth embodiments can reduce the number of output channels of the data driver 410 by ¾ compared to the pixel arrangement structure according to the first embodiment. Accordingly, although the second blue sub-pixel B2 is added to the pixel arrangement structures according to the third to fifth embodiments, a data driver that is applied to a stripe type of pixel arrangement structure having a red sub-pixel, green sub-pixel, and blue sub-pixel can be applied to the pixel arrangement structures according to the third to fifth embodiments as-is.

Figure 10:
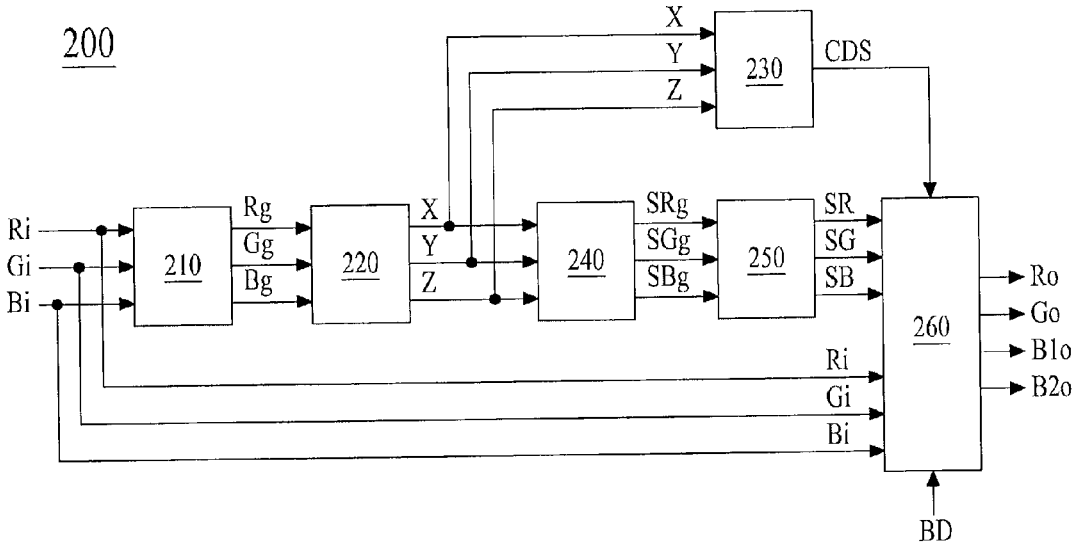
FIG. 10 is a block diagram schematically illustrating a data converter of FIG. 1.

Referring again to FIG. 1, the data converter 200 gamma-corrects three-color input data Ri, Gi and Bi that respectively have red, green, and blue and are inputted from an external system body (not shown) or a graphic card (not shown). The data converter 200 performs color coordinate conversion based on the gamma-corrected blue data Bg to generate three-color conversion data and a color gamut determination signal, and inversely gamma-corrects the three-color conversion data. The data converter 200 generates four-color image data Ro, Go, B1*o* and B2*o* to be respectively supplied to the red sub-pixel R, green sub-pixel G, first blue sub-pixel B1, and second sub-pixel B2 according to the color gamut determination signal, based on the three-color input data Ri, Gi and Bi, black data, and the inversely gamma-corrected three-color conversion data. For this end, as illustrating in FIG. 10, the data converter 200 includes a gamma correction unit 210, a color coordinate conversion unit 220, a color gamut determination unit 230, a color coordinate inverse conversion unit 240, an inverse gamma correction unit 250, and a four-color image data generation unit 260.

The gamma correction unit 210 reflects the gamma characteristic of the display panel 100, which receives the three-color input data Ri, Gi and Bi respectively having red, green, and blue, to gamma-correct the three-color input data Ri, Gi and Bi respectively having red, green, and blue, and supplies the gamma-corrected three-color input data Rg, Gg and Bg to the color coordinate conversion unit 220.

The color coordinate conversion unit 220 converts the color coordinates of the gamma-corrected three-color input data Rg, Gg and Bg based on the blue data Bg of the gamma-corrected three-color input data Rg, Gg and Bg to XYZ color coordinate data, and supplies the XYZ color coordinate data to the color gamut determination unit 230 and color coordinate inverse conversion unit 240. Specifically, the color coordinate conversion unit 220 performs RGB-to-XYZ color coordinate conversion based on the Commission Internationale de l'Eclairage (CIE) 1931 standard colorimetric system (hereinafter referred to as a CIE colorimetric system). The color coordinate conversion, for example, may be performed as expressed in Equation (1) below.

$$\begin{bmatrix} X \\ Y \\ Z \end{bmatrix} = M_{B2} \begin{bmatrix} Rg \\ Gg \\ Bg \end{bmatrix} \quad (1)$$

where $M_{B2}$ denotes a conversion matrix that converts the gamma-corrected three-color input data Rg, Gg and Bg into the XYZ color coordinate data when the gamma-corrected blue data Bg is assumed as having deep blue.

The color coordinate conversion unit 220 may automatically generate the XYZ color coordinate data by mapping the gamma-corrected three-color input data Rg, Gg and Bg, with a look-up table for color coordinate conversion based on deep blue.

The color gamut determination unit 230 determines whether the XYZ color coordinate data correspond to a first color gamut or second color gamut of the CIE colorimetric system.

Figure 11:
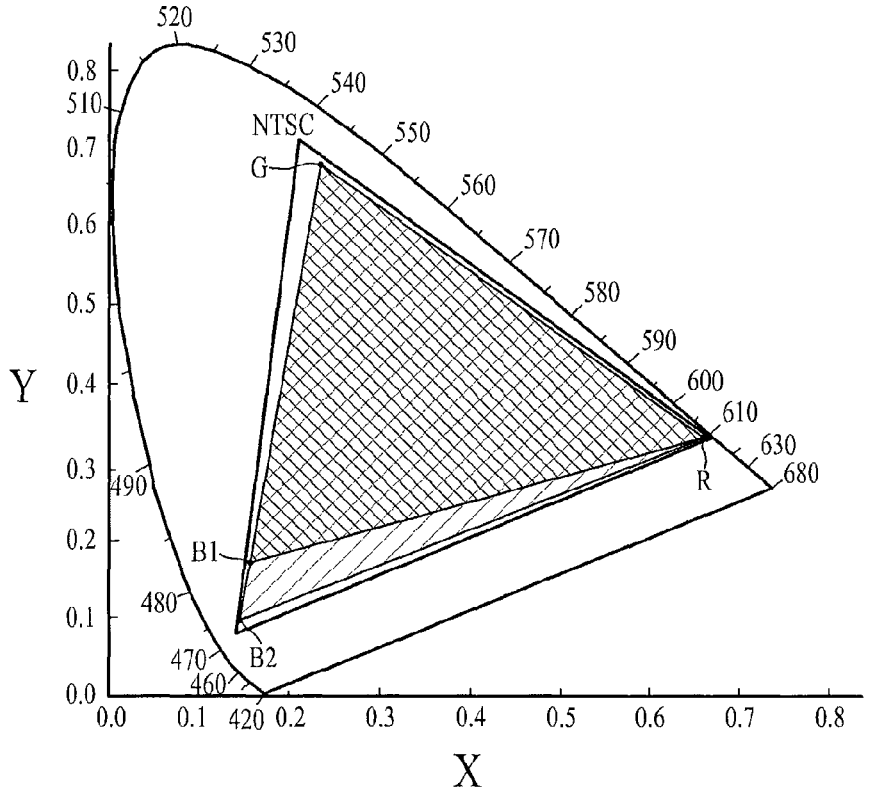
FIG. 11 is a diagram illustrating Commission Internationale de l'Eclairage (CIE) 1931 standard colorimetric system.

Specifically, as illustrated in FIG. 11, the CIE colorimetric system has a first color gamut (▧) that is defined by red R, green G, and first blue B1, and a second color gamut (▨) that is defined by red R, green G, and second blue B2. In the CIE colorimetric system, blue B may be defined as first blue B1 when a Y value is more than or equal to 0.15, and blue B may be defined as second blue B2 when a Y value is less than 0.15. As seen from FIG. 9, the second color gamut (▨) may realize color having a broader range than the first color gamut (▧).

Therefore, the color gamut determination unit 230 determines whether current three-color input data Ri, Gi and Bi correspond to the first color gamut (▧) or second color gamut (▨) on the basis of the XYZ color coordinate data, and generates a color determination signal CDS according to the determined result to supply the color determination signal CDS to the four-color image data generation unit 260. That is, when a Y value in the XYZ color coordinate data is more than or equal to 0.15, the color gamut determination unit 230 determines the three-color input data Ri, Gi and Bi as corresponding to the first color gamut (▧) and thus generates a first logic level of color determination signal CDS. However, when the Y value is less than 0.15, the color gamut determination unit 230 generates a second logic level of color determination signal CDS.

The color coordinate inverse conversion unit 240 performs color coordinate inverse conversion on the XYZ color coordinate data supplied from the color coordinate conversion unit 220 to generate three-color conversion data SRg, SGg and SBg that are data RGB, and supplies the three-color conversion data SRg, SGg and SBg to the inverse gamma correction unit 250. In detail, the color coordinate inverse conversion unit 240 performs XYZ-to-RGB color coordinate inverse conversion, based on first blue B1. Such color coordinate inverse conversion, for example, may be performed as expressed in Equation (2) below.

$$\begin{bmatrix} R \\ G \\ B \end{bmatrix} = M_{B1}^{-1} \begin{bmatrix} X \\ Y \\ Z \end{bmatrix} \quad (2)$$

where $M_{B1}^{-1}$ denotes an inverse conversion matrix that converts the XYZ color coordinate data into the data RGB, based on sky-blue.

The color coordinate inverse conversion unit 240 may generate the three-color conversion data SRg, SGg and SBg by mapping the XYZ color coordinate data, with a look-up table for color coordinate inverse conversion based on sky-blue.

The three-color conversion data SRg, SGg and SBg outputted from the color coordinate inverse conversion unit 240 correspond to image data that are respectively supplied to a red sub-pixel R, green sub-pixel G, and first blue sub-pixel B1 of a unit pixel UP, thereby realizing color that corresponds to the first color gamut (▧) of the CIE colorimetric system.

Since gamma characteristic has been reflected in the three-color input data Ri, Gi and Bi by the gamma correction unit 210, the inverse gamma correction unit 250 inversely gamma-corrects the three-color conversion data SRg, SGg and SBg supplied from the color coordinate inverse conversion unit 240 in order to remove the reflected gamma characteristic, and supplies the inversely gamma-corrected three-color conversion data SR, SG and SB to the four-color image data generation unit 260. Herein, the three-color conversion data SR, SG and SB includes first red data SR, first green data SG, and first blue data SB.

Figure 12:
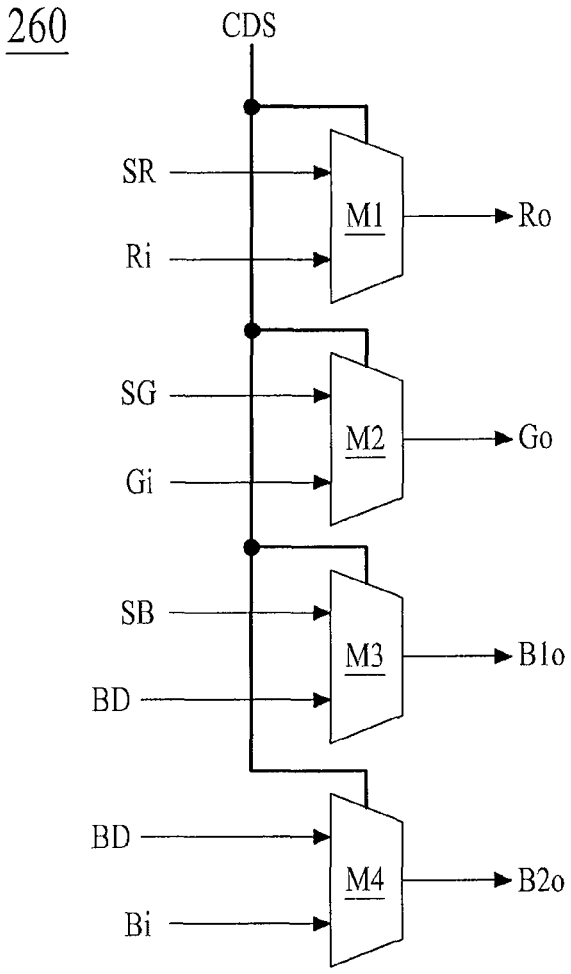
FIG. 12 is a block diagram schematically illustrating a four-color image data generation unit of FIG. 10.

The four-color image data generation unit 260 generates the four-color image data Ro, Go, B1*o* and B2*o* to be respectively supplied to the red sub-pixel R, green sub-pixel G, first blue sub-pixel B1, and second sub-pixel B2 according to the color determination signal CDS supplied to the color gamut determination unit 230, based on the black data BD, the three-color input data Ri, Gi and Bi, and the three-color conversion data SR, SG and SB supplied from the inverse gamma correction unit 250. Herein, the three-color input data Ri, Gi and Bi inputted to the four-color image data generation unit 260 correspond to image data that are respectively supplied to a red sub-pixel R, green sub-pixel G, and second blue sub-pixel B2 of a unit pixel UP, thereby realizing color that corresponds to the second color gamut (▨) of the CIE colorimetric system. For this end, as illustrated in FIG. 12, the four-color image data generation unit 260 includes first to fourth selectors M1 to M4.

The first selector M1 includes a first input terminal that receives the red conversion data SR, a second input terminal that receives the red input data Ri, a control terminal that receives the color determination signal CDS, and an output terminal connected to the timing controller 300. The first selector M1 supplies the red conversion data SR to the timing controller 300 according to a first logic level of color determination signal CDS, and supplies the red input data Ri to the timing controller 300 according to a second logic level of color determination signal CDS. Herein, the red conversion data SR or red input data Ri that is supplied from the first selector M1 to the timing controller 300 corresponds to the red image data Ro that will be supplied to a red sub-pixel R of a unit pixel UP.

The second selector M2 includes a first input terminal that receives the green conversion data SG, a second input terminal that receives the green input data Gi, a control terminal that receives the color determination signal CDS, and an output terminal connected to the timing controller 300. The second selector M2 supplies the green conversion data SG to the timing controller 300 according to the first logic level of color determination signal CDS, and supplies the green input data Gi to the timing controller 300 according to the second logic level of color determination signal CDS. Herein, the green conversion data SG or green input data Gi that is supplied from the second selector M3 to the timing controller 300 corresponds to the green image data Go that will be supplied to a green sub-pixel R of a unit pixel UP.

The third selector M3 includes a first input terminal that receives the blue conversion data SB, a second input terminal that receives the black data BD, a control terminal that receives the color determination signal CDS, and an output terminal connected to the timing controller 300. The third selector M3 supplies the blue conversion data SB to the timing controller 300 according to the first logic level of color determination signal CDS, and supplies the black data BD to the timing controller 300 according to the second logic level of color determination signal CDS. Herein, the black data BD may have a data value that disallows the first blue sub-pixel B1 to emit light. The blue conversion data SB or black data BD that is supplied from the third selector M3 to the timing controller 300 corresponds to the first blue image data B1*o* that will be supplied to a first blue sub-pixel B1 of a unit pixel UP.

The fourth selector M4 includes a first input terminal that receives the black data BD, a second input terminal that receives the blue input data Bi, a control terminal that receives the color determination signal CDS, and an output terminal connected to the timing controller 300. The fourth selector M4 supplies the black data BD to the timing controller 300 according to the first logic level of color determination signal CDS, and supplies the blue input data Bi to the timing controller 300 according to the second logic level of color determination signal CDS. Herein, the black data BD may have a data value that disallows the second blue sub-pixel B2 to emit light. The blue input data Bi or black data BD that is supplied from the fourth selector M4 to the timing controller 300 corresponds to the second blue image data B2*o* that will be supplied to a second blue sub-pixel B2 of a unit pixel UP.

As a result, when the color determination signal CDS has the first logic level, the four-color image data generation unit 260 supplies the four image data Ro, Go, B1*o* and B2*o*, including the red conversion data SR, green conversion data SG, blue conversion data SB, and black data BD, to the timing controller 300. When the color determination signal CDS has the second logic level, the four-color image data generation unit 260 supplies the four image data Ro, Go, B1*o* and B2*o*, including the red input data Ri, green input data Gi, black data BD, and blue input data Bi, to the timing controller 300.

The data converter 200 may be built in the timing controller 300.

Referring again to FIG. 1, the timing controller 300 controls the driving timing of the panel driver 400 according to a timing sync signal TSS that is inputted from the external system body (not shown) or graphic card (not shown). In this case, the panel driver 400 may include the data driver 410 and scan driver 420 that will be described below. Therefore, the timing controller 500 generates a scan control signal SCS and a data control signal DCS on the basis of the timing sync signal TSS which includes a vertical sync signal Vsync, horizontal sync signal Hsync, data enable signal DE, and clock CLK, thereby controlling the driving timing of the scan driver 420 and data driver 410.

Moreover, the timing controller 300 aligns the four-color image data Ro, Go, B1*o* and B2*o* (which are sequentially supplied from the data converter 200) for one horizontal line by one horizontal line unit so as to correspond to the pixel arrangement structure of the display panel 100, and supplies the aligned data to the data driver 410.

When the display panel 100 has the pixel arrangement structure according to the first embodiment (see FIG. 3), a timing controller 300 according to the first embodiment aligns the four-color image data Ro, Go, B1*o* and B2*o* for one horizontal line in the order of blue, red, first blue, and second blue, and supplies the aligned data to the data driver 410.

When the display panel 100 has the pixel arrangement structure according to the second embodiment (see FIG. 4), the timing controller 300 according to the second embodiment aligns the blue data and green data of the four-color image data Ro, Go, B1*o* and B2*o* in the order of blue and red, and supplies the aligned data to the data driver 410. Subsequently, the timing controller 300 according to the second embodiment aligns the first blue data and second blue data of the four-color image data Ro, Go, B1*o* and B2*o* in the order of first blue and second blue, and supplies the aligned data to the data driver 410.

Figure 13A:
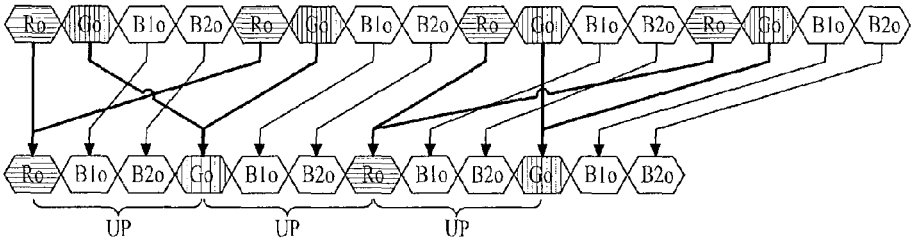
FIGS. 13A and 13B are diagrams for describing pixel rendering which is performed by a timing controller of FIG. 1.
Figure 13B:
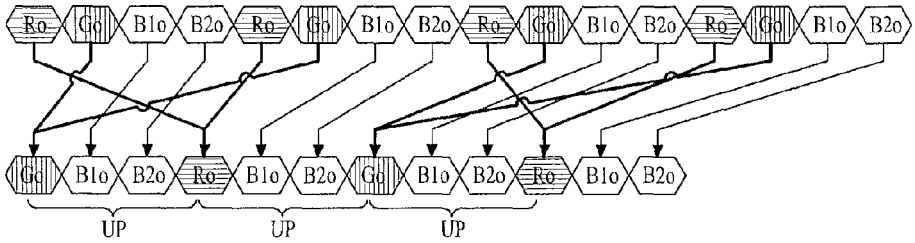

When the display panel 100 has the pixel arrangement structure according to the third embodiment (see FIG. 5), a timing controller 300 according to the third embodiment aligns the four-color image data Ro, Go, B1*o* and B2*o* for one horizontal line in order for two adjacent unit pixels UP to share a red sub-pixel R or green sub-pixel G, through pixel rendering and supplies the aligned data to the data driver 410. For example, as illustrated in FIG. 13A, the timing controller 300 repeatedly aligns the four-color image data Ro, Go, B1*o* and B2*o* for one horizontal line in the order of red shared data Ro (▤), first blue data B1*o*, second blue data B2*o*, green shared data Go (▧), first blue data B1*o*, and second blue data B2*o* through pixel rendering, in an odd-numbered horizontal duration. Furthermore, as illustrated in FIG. 13B, the timing controller 300 repeatedly aligns the four-color image data Ro, Go, B1*o* and B2*o* for one horizontal line in the order of green shared data Go (▧), first blue data B1*o*, second blue data B2*o*, red shared data Ro (▤), first blue data B1*o*, and second blue data B2*o* through pixel rendering, in the odd-numbered horizontal duration. Alternatively, the timing controller 300 may repeatedly align the four-color image data Ro, Go, B1*o* and B2*o* for one horizontal line in the order of green shared data Go (▧), second blue data B2*o*, first blue data B1*o*, red shared data Ro (▤), second blue data B2*o*, and first blue data B1*o* through pixel rendering which corresponds to the pixel arrangement structure of FIG. 6, in the odd-numbered horizontal duration.

When two adjacent unit pixels UP share a red sub-pixel R, the timing controller 300 generates an average value of two adjacent red data Ro among the four-color image data Ro, Go, B1*o* and B2*o* as red shared data Ro (▤) that will be supplied to the shared red sub-pixel R. Likewise, when two adjacent unit pixels UP share a green sub-pixel, the timing controller 300 generates an average value of two adjacent green data Go among the four-color image data Ro, Go, B1*o* and B2*o* as green shared data Go (▧) that will be supplied to the shared green sub-pixel G.

When the display panel 100 has the pixel arrangement structure according to the fourth embodiment (see FIG. 7 or 8), a timing controller 300 according to the fourth embodiment aligns the four-color image data Ro, Go, B1*o* and B2*o* for one horizontal line in order for two adjacent unit pixels UP to share a red sub-pixel R or second blue sub-pixel B2, through pixel rendering that is the same as that of the timing controller 300 according to the third embodiment, and supplies the aligned data to the data driver 410.

When the display panel 100 has the pixel arrangement structure according to the fifth embodiment (see FIG. 9), a timing controller 300 according to the fifth embodiment aligns the four-color image data Ro, Go, B1*o* and B2*o* for one horizontal line in order for two adjacent unit pixels UP to share a red sub-pixel R or first and second blue sub-pixels B1 and B2, through pixel rendering that is the same as that of the timing controller 300 according to the third embodiment, and supplies the aligned data to the data driver 410.

Referring again to FIG. 1, the data driver 410 converts the four-color image data Ro, Go, B1*o* and B2*o*, supplied from the timing controller 300, into respective analog data signals according to the data control signal DCS supplied from the timing controller 300. That is, the data driver 410 sequentially latches the sequentially supplied four-color image data Ro, Go, B1*o* and B2*o* for one horizontal line, and selects a gamma voltage, corresponding to each of the latched four-color image data Ro, Go, B1*o* and B2*o*, from among different gamma voltages as a data signal to supply the selected data signal to a corresponding data line DL, in response to the data control signal DCS. Herein, the different gamma voltages may be set separately or in common, based on luminance characteristics of red, green, first blue, and second blue organic light emitting materials.

The scan driver 420 generates a scan signal by horizontal duration unit and sequentially supplies a plurality of scan lines SL, according to the scan control signal SCS supplied from the timing controller 300. Therefore, a switching transistor ST of each sub-pixel R/G/B1/B2 is turned on by the scan signal supplied to a scan line SL and supplies a data signal, supplied to a data line DL, to a gate electrode of a driving transistor DT. Thus, the driving transistor DT supplies a current corresponding to the data signal to an organic light emitting element OLED to emit light from the organic light emitting element OLED.

In the above-described apparatus and method for driving the organic light emitting display device, each of the unit pixels UP is configured with a red sub-pixel R, a green sub-pixel G, a first blue sub-pixel B1, and a second blue sub-pixel B2, and the first blue sub-pixel B1 or second blue sub-pixel B2 selectively emits light according to a color gamut, including the three-color input data Ri, Gi and Bi, among the first color gamut and second color gamut of the CIE colorimetric system, thus extending the service life of the organic light emitting display device and enhancing color reproducibility. That is, the present invention selectively emits light from a first blue sub-pixel B1 of a first blue organic light emitting material or a second blue sub-pixel B2 of a second blue organic light emitting material according to colors of the three-color input data Ri, Gi and Bi to be supplied to a unit pixel UP, and thus can extend the service life of the blue sub-pixels B1 and B2, thereby extending the service life of the organic light emitting display device. Accordingly, a color reproduction rate can be enhanced by the second blue sub-pixel B2.

Moreover, the present invention performs gamma correction before converting the color coordinates of the three-color input data Ri, Gi and Bi, and thereafter performs inverse gamma correction after converting the color coordinates of the three-color input data Ri, Gi and Bi, thus realizing color with gamma characteristic of the organic light emitting element OLED reflected therein.

Furthermore, the present invention arranges sub-pixels R, G, B1 and B2 of each unit pixel UP in the quad type, allows adjacent unit pixels UP to share one sub-pixel or two sub-pixels, and performs pixel rendering based on the pixel arrangement structure, thus enhancing visual resolution without the increase in the number of channels of the data driver 410.

As described above, in the apparatus and method for driving the organic light emitting display device, each of the unit pixels is configured with the red sub-pixel, green sub-pixel, first blue sub-pixel, and second blue sub-pixel, and the first blue sub-pixel or second blue sub-pixel selectively emits light according to the color gamut including the input data RGB in the CIE color coordinate system by using the XYZ color coordinates of the input data RGB, thus extending the service life of the organic light emitting display device and enhancing color reproducibility.

In the embodiments of the present invention, gamma correction is performed before converting the color coordinate of the input data, and thereafter inverse gamma correction is performed after converting the color coordinate of the input data, thus realizing color with gamma characteristic of the organic light emitting element reflected therein.

In the embodiments of the present invention, the red sub-pixel, green sub-pixel, first blue sub-pixel, and second blue sub-pixel are arranged in the quad type, and adjacent unit pixels share one sub-pixel or two sub-pixels, thus enhancing visual resolution through pixel rendering based on the pixel arrangement structure.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A driving apparatus of an organic light emitting display device, the driving apparatus comprising:

a display panel comprising a plurality of unit pixels, which comprise a red sub-pixel, green sub-pixel, first blue sub-pixel, and second blue sub-pixel and which are arranged in a certain type of pixel arrangement structure in respective areas which are defined by a plurality of scan lines and data lines;

a data converter generating four-color image data to be supplied to a unit pixel on the basis of the three-color input data having red, green, and blue;

a timing controller aligning the four-color image data in correspondence with the pixel arrangement structure; and a panel driver supplying a data signal, corresponding to each of the four-color image data which are aligned and supplied by the timing controller, to a corresponding sub-pixel, wherein the data converter comprises:

a gamma correction unit gamma-correcting the three-color input data;

a color coordinate conversion unit converting color coordinates of the gamma-corrected three-color input data, based on blue data of the gamma-corrected three-color input data, to generate XYZ color coordinate data;

a color gamut determination unit generating a first logic level of color gamut determination signal or a second logic level of color gamut determination signal, based on a CIE colorimetric system which comprises a first color gamut defined by red, green, and first blue, and a second color gamut defined by red, green, and second blue, wherein the color gamut determination unit generates the first logic level of color gamut determination signal when the XYZ color coordinate data are comprised in the first color gamut, or generates the second logic level of color gamut determination signal when the XYZ color coordinate data are comprised in the second color gamut;

a color coordinate inverse conversion unit performing color coordinate inverse conversion on the XYZ color coordinate data to generate the three-color conversion data; and a four-color image data generation unit generating the four-color image data according to the first or second logic level of color gamut determination signal, on the basis of the three-color input data and the inversely gamma-corrected three-color conversion data.

2. The driving apparatus according to claim 1, wherein, the four-color image data generation unit generates one of:

the four-color image data which comprise the three-color conversion data to be supplied to the red sub-pixel, green sub-pixel, and first blue sub-pixel, and black data to be supplied to the second blue sub-pixel, according to the first logic level of color gamut determination signal, or the four-color image data which comprise the three-color input data to be supplied to the red sub-pixel, green sub-pixel, and second blue sub-pixel, and the black data to be supplied to the first blue sub-pixel, according to the second logic level of color gamut determination signal.

3. The driving apparatus according to claim 2, wherein the black data has a data value which disallows the first or second blue sub-pixel to emit light.

4. The driving apparatus according to any one of claim 1, wherein the red sub-pixel, green sub-pixel, first blue sub-pixel, and second sub-pixel of each of the unit pixels are arranged in a stripe type of pixel arrangement structure.

5. The driving apparatus according to any one of claim 1, wherein the red sub-pixel, green sub-pixel, first blue sub-pixel, and second sub-pixel of each of the unit pixels are arranged in a quad type of pixel arrangement structure.

6. The driving apparatus according to claim 1, wherein two adjacent unit pixels share one or two of a red sub-pixel, green sub-pixel, first blue sub-pixel, and second blue sub-pixel which configure one unit pixel, the one or two sub-pixel being a shared sub-pixel.

7. The driving apparatus according to claim 6, wherein the timing controller generates an average value of two adjacent data of the four-color image data for one horizontal line as shared data to be supplied to the shared sub-pixel, the two adjacent data having the same color as the shared sub-pixel.

8. The driving apparatus according to claim 7, wherein, the shared sub-pixel is the red sub-pixel or green sub-pixel, and the first and second blue sub-pixels of each of the unit pixels are arranged in two rows between the red sub-pixel and green sub-pixel.

9. The driving apparatus according to claim 8, wherein the first and second blue sub-pixels, which are arranged in two rows, are arranged identically or alternately along a length direction of a data line.

10. The driving apparatus according to claim 7, wherein, the shared sub-pixel is the red sub-pixel or second blue sub-pixel, and the first blue sub-pixel and green sub-pixel of each of the unit pixels are arranged in two rows between the red sub-pixel and second blue sub-pixel.

11. The driving apparatus according to claim 10, wherein the first blue sub-pixel and green sub-pixel, which are arranged in two rows, are arranged identically or alternately along a length direction of a data line.

12. The driving apparatus according to claim 7, wherein, the shared sub-pixel is a red sub-pixel or first and second blue sub-pixels, and the first and second blue sub-pixels are arranged in two rows between green sub-pixels.

13. A driving method of an organic light emitting display device, the driving method comprising:

gamma-correcting three-color input data having red, green, and blue;

performing color coordinate conversion based on the gamma-corrected blue data to generate three-color conversion data and a color gamut determination signal;

inversely gamma-correcting the three-color conversion data;

generating four-color image data to be supplied to a unit pixel according to the color gamut determination signal on the basis of the three-color input data and the inversely gamma-corrected three-color conversion data, wherein the unit pixel comprises a red sub-pixel, a green sub-pixel, a first blue sub-pixel, and a second blue sub-pixel;

aligning the four-color image data in correspondence with a pixel arrangement structure of the unit pixel; and supplying a data signal, corresponding to each of the aligned four-color image data, to a corresponding sub-pixel, wherein the generating of three-color conversion data and a color gamut determination signal comprises:

converting color coordinates of the gamma-corrected three-color input data, based on blue data of the gamma-corrected three-color input data, to generate XYZ color coordinate data;

generating a first logic level of color gamut determination signal or a second logic level of color gamut determination signal, based on a CIE colorimetric system which comprises a first color gamut defined by red, green, and first blue, and a second color gamut defined by red, green, and second blue, wherein the first logic level of color gamut determination signal is generated when the XYZ color coordinate data are comprised in the first color gamut, or the second logic level of color gamut determination signal is generated when the XYZ color coordinate data are comprised in the second color gamut; and performing color coordinate inverse conversion on the XYZ color coordinate data to generate the three-color conversion data.

14. The driving method according to claim 13, wherein the generating of four-color image data comprises:

generating the four-color image data which comprise the three-color conversion data to be supplied to the red sub-pixel, green sub-pixel, and first blue sub-pixel, and black data to be supplied to the second blue sub-pixel, according to the first logic level of color gamut determination signal, or generating the four-color image data which comprise the three-color input data to be supplied to the red sub-pixel, green sub-pixel, and second blue sub-pixel, and the black data to be supplied to the first blue sub-pixel, according to the second logic level of color gamut determination signal.

15. The driving method according to claim 14, wherein the black data has a data value which disallows the first or second blue sub-pixel to emit light.

16. The driving method according to any one of claim 13, wherein, the aligning of the four-color image data comprises:

generating shared data to be supplied to one or two of the red sub-pixel, green sub-pixel, first blue sub-pixel, and second blue sub-pixel, wherein the one sub-pixel or two sub-pixels is or are shared by two adjacent unit pixels; and aligning four-color data which comprise the shared data, in correspondence with a pixel arrangement structure which comprises a sub-pixel shared by the two adjacent unit pixels, and the shared data is an average value of two adjacent data of the four-color image data for one horizontal line, and the two adjacent data have the same color as the shared sub-pixel.

* * * * *